US005676248A

United States Patent [19]

Brazell

[11] Patent Number: 5,676,248

[45] Date of Patent: Oct. 14, 1997

[54] OPEN FACE DISPLAY CARTON AND MOTORIZED IMPLEMENT ARRANGEMENT

[75] Inventor: Kenneth M. Brazell, Phoenix, Ariz.

[73] Assignee: Ryobi North America Corp., Easley, S.C.

[21] Appl. No.: 685,816

[22] Filed: Jul. 25, 1996

[51] Int. Cl.[6] ..... B65D 85/68

[52] U.S. Cl. ..... 206/319; 206/349; 206/756; 206/588

[58] Field of Search ..... 206/319, 349, 206/335, 756, 763, 765, 588, 590

[56] References Cited

U.S. PATENT DOCUMENTS

| | | |
|---|---|---|
| 2,291,645 | 8/1942 | Nordquist . |
| 2,727,620 | 12/1955 | Buttery . |
| 2,752,035 | 6/1956 | Shinoda . |
| 3,481,453 | 12/1969 | Shreve, III et al. . |
| 3,570,658 | 3/1971 | Swanberg . |
| 3,669,253 | 6/1972 | Hanko . |
| 3,741,380 | 6/1973 | Carney . |
| 3,747,831 | 7/1973 | Hanson . |
| 3,747,835 | 7/1973 | Graser . |
| 3,825,113 | 7/1974 | Kramer et al. . |
| 3,874,500 | 4/1975 | Nicholl . |
| 3,929,225 | 12/1975 | Looke et al. ..... 206/335 |
| 4,171,050 | 10/1979 | Murray et al. . |
| 4,247,003 | 1/1981 | Jones . |
| 4,287,991 | 9/1981 | Donnelly . |
| 4,354,598 | 10/1982 | Schillinger . |
| 4,549,654 | 10/1985 | Tiesman . |
| 4,848,563 | 7/1989 | Robbins . |
| 4,915,224 | 4/1990 | Wulf et al. . |
| 5,048,677 | 9/1991 | Pedracine . |
| 5,114,002 | 5/1992 | Warner . |
| 5,495,937 | 3/1996 | Fraser . |

*Primary Examiner*—David T. Fidei
*Attorney, Agent, or Firm*—Brooks & Kushman P.C.

[57] ABSTRACT

An open face display carton and motorized implement arrangement is disclosed. The display arrangement includes an operator carriable motorized implement and an open face display carton. Ideally, the motorized implement is split into a tool portion and a motorized portion. The display carton has a main body and upper and lower inserts. The main body has a central portion and top and bottom portions which retain the upper and lower inserts therein. The main body includes a rear panel with a pair of outer panels which extend forwardly from the rear panel and a pair of inner panels which extend from the outer panels toward the rear panel defining an open region between the inner panels. The respective motorized and tool portions are preferably retained in generally upright positions by the carton with at least a portion of each of the motorized and tool portions being tactiley accessible within the open region of the carton. The carton is substantially shorter in height than the fully assembled motorized implement. End portions of the motorized and tool portions are retained within the upper and lower inserts. Ideally, at least one visual access opening is formed in at least one of the upper and lower portions of the main body to provide visual access to a retained end of one of the motorized and tool portions.

11 Claims, 5 Drawing Sheets

OPEN FACE DISPLAY CARTON AND MOTORIZED IMPLEMENT ARRANGEMENT

TECHNICAL FIELD

This invention relates to open face display cartons which retain and display motorized implements therein.

BACKGROUND OF THE INVENTION

Open face cartons for retaining and displaying motorized implements are known. Examples include U.S. Pat. Nos. 5,495,937 and 5,332,085. In these patents, motorized implements such as line trimmers and vacuum cleaners are fully assembled and displayed within open face cartons. The line trimmers are generally ready to use once they are removed from the carton. The open face design allows potential purchasers to view and tactiley access the line trimmer at a point of purchase. This presents a substantial sales advantage over comparable products which are packaged completely hidden within closed boxes.

The open face cartons described above have a couple of drawbacks. As the line trimmers are of a substantial height when fully assembled, the open face cartons are also quite tall. This can provide problems during shipping and also during display on store shelves. Further, end portions of the line trimmers are held by inserts within the open face display cartons. While the vast majority of an overall line trimmer is exposed for the purchaser's examination and consideration, the end portions held within the inserts are hidden from the purchaser's view. These portions often contain some of the most interesting and saleable features of the line trimmer or like motorized implement.

The present invention addresses these drawbacks.

SUMMARY OF THE INVENTION

It is an object of the present invention to provide an open face display carton and motorized implement arrangement which is reduced in height yet provides ready visual inspection of highly desirable sales features of a motorized implement even though the desirable sales features are retained within inserts and are not visible through an open region or face of the open face display carton.

It is another object to provide a compact open face display carton and motorized implement arrangement wherein the motorized implement is disassembled into two elongate portions which are disposed upright adjacent one another and have ends which are held within inserts, of the display carton while most of the elongate portions are still tactiley accessible in an open region of the display carton.

It is a further object of the present invention to provide an open face display carton and motorized implement arrangement which has ends of the motorized implement retained within upper and lower portions of the display carton while the center portion of the motorized implement is tactiley accessible in an intermediate open region and wherein at least one of the upper and lower portions of the display carton has a visual access opening providing visual access to a retained end of the motorized implement.

An open face display carton and motorized implement arrangement is disclosed. The arrangement includes an operator carriable motorized implement and an open face display carton. Ideally, the motorized implement is split into a tool portion and a motorized portion. The display carton has a main body and upper and lower inserts. The main body has a central portion and top and bottom portions which retain the upper and lower inserts therein. The main body includes a rear panel with a pair of outer panels which extend forwardly from the rear panel and a pair of inner panels which extend from the outer panels toward the rear panels defining an open region between the inner panels. The respective motorized and tool portions are retained in generally upright positions by the carton with at least a portion of each of the motorized and tool portions be tactiley accessible within the open region of the carton. The carton is ideally substantially shorter in height than the fully assembled motorized implement. End portions of the motorized and tool portions are retained within the upper and lower inserts. Ideally, a visual access opening is formed in at least one of the upper and lower portions of the main body to provide visual access to a retained end of one of the motorized and tool portions.

BRIEF DESCRIPTION OF THE DRAWINGS

These and other features, objects and advantages of the present invention will become readily apparent from the following description, pending claims, and accompanying sheets of drawings where:

BEST MODE FOR CARRYING OUT THE INVENTION

Figure 1:
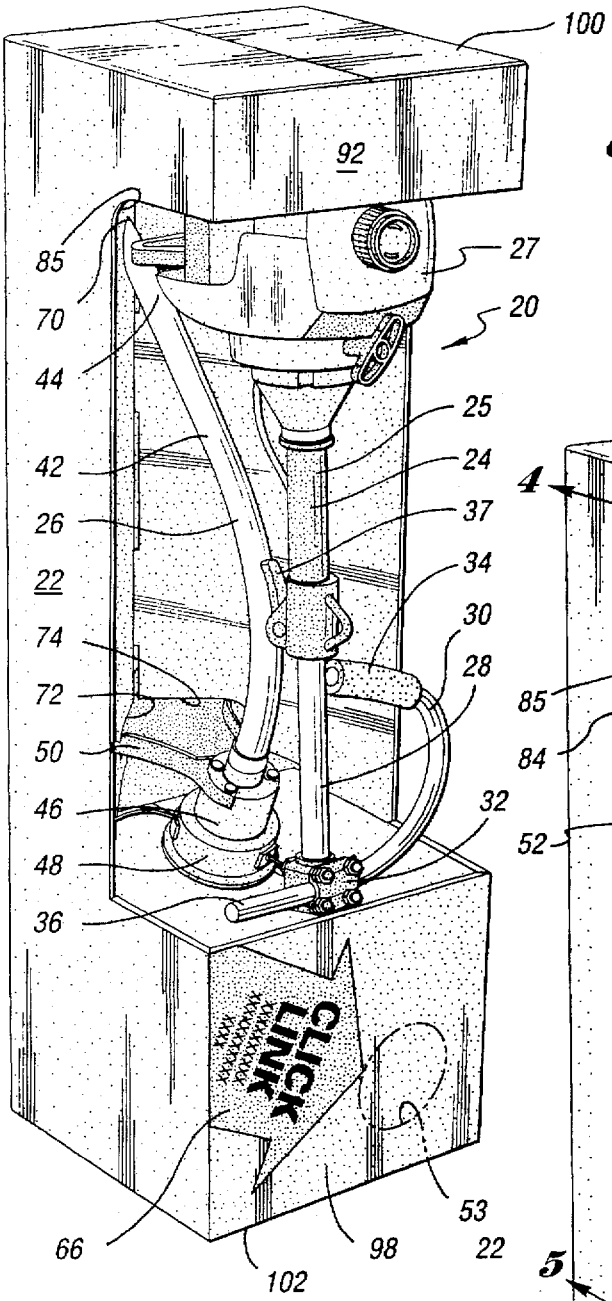
FIG. 1 is a perspective view of an open face display carton and motorized implement arrangement made in accordance with the present invention.

FIG. 1 shows an open face display carton and motorized implement arrangement 20, made in accordance with the present invention. Display arrangement 20 comprises an open face carton 22 which retains a motorized implement, which in this exemplary embodiment, is line trimmer 24, which is hand carriable. Line trimmer 24 is shown in a two-piece disassembled configuration retained within carton 22. The majority of line trimmer 24 is tactiley accessible by a purchaser as is readily apparent from FIG. 1. Further, as line trimmer 24 is partially disassembled, the overall height of carton 22 is substantially reduced over that which would be required to retain line trimmer 24 if it were fully assembled.

Line trimmer 24 includes a motorized portion 25 and a tool portion 26. Motorized portion 25 has a motor 27 and a first boom section 28 extending from motor 27. A handle 30 is clampingly connected by a clamp 32 to first boom section 28. Handle 30 is generally C-shaped having a foam covered grip 34 and a distal end 36 which extends through clamp 32. Also mounted on first boom section 28 is a trigger mechanism 37 which controls the operation of line trimmer 24. As indicated in phantom in FIG. 5, first boom section 28 also has a distal end 38 to which a telescopic quick release connector 40 is mounted. Connector 40 is more fully described in U.S. patent application Ser. No. 08/303,320, entitled "Attachment System For A Battery Powered Tool" which is hereby incorporated by reference.

Tool portion 26 has a second boom section 42 which may be operatively connected to first boom section 28 by simply telescopically inserting second boom section 42 into connector 40. Tool portion 26 includes a distal end 44 and a tool 46, both of which are retained in carton 22. In this exemplary embodiment, tool 46 includes a line trimmer head 48 having a line advance button 49 at the end thereof. Line advance button 49 is shown, in phantom, being retained by carton 22 in FIG. 5. A guard 50 is fastened to line trimmer head 48.

Figure 2:
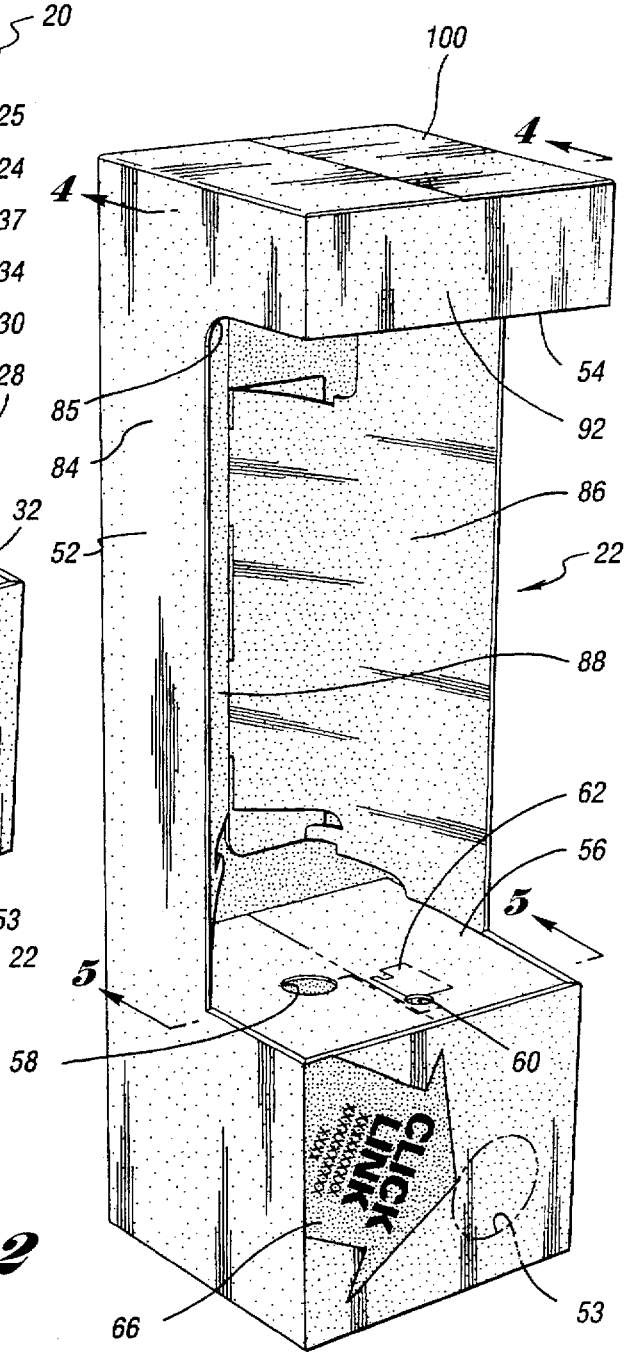
FIG. 2 is a perspective view of the display carton without the motorized implement therein.
Figure 6:
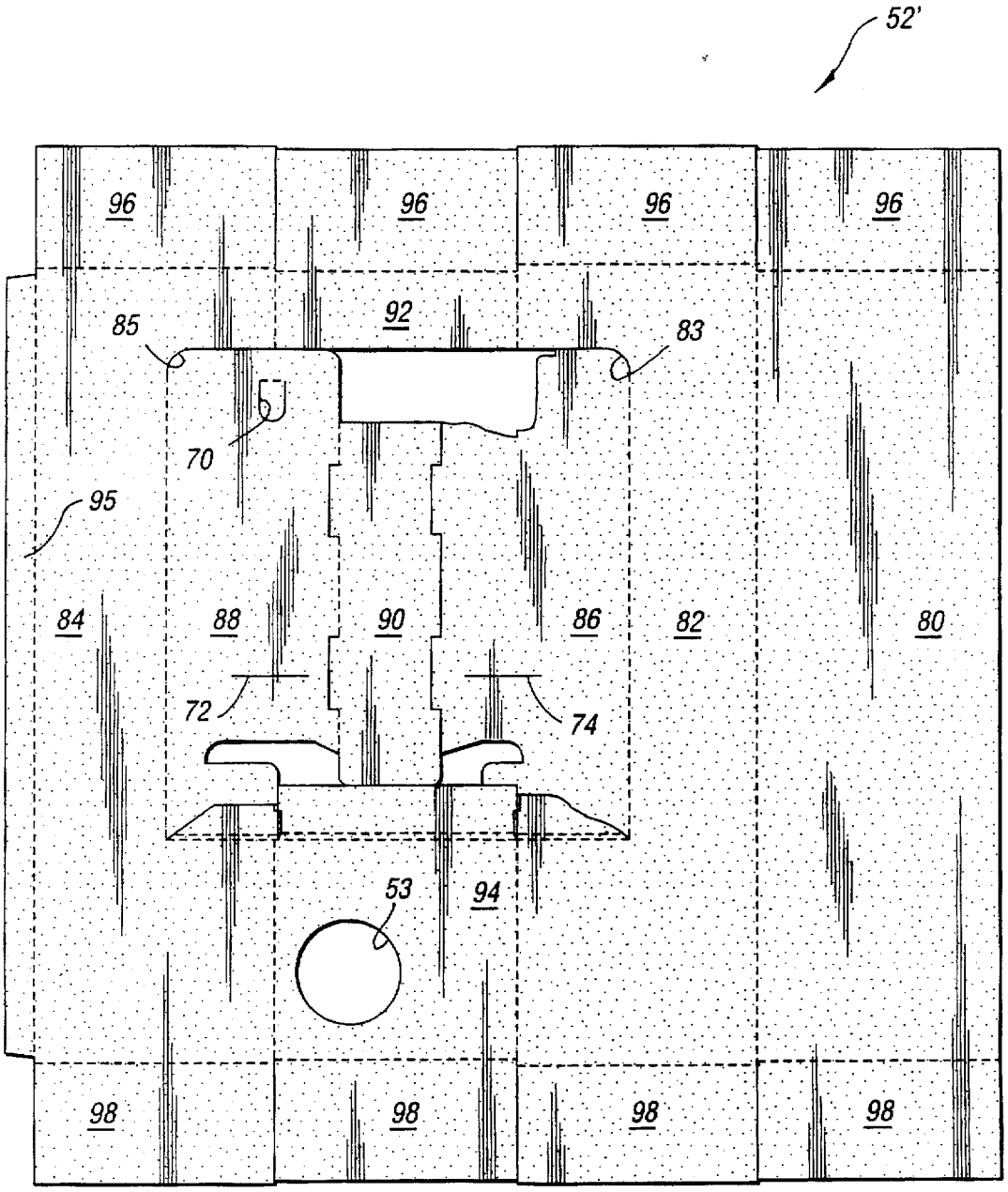
FIG. 6 is a plan view of the unfolded main body.
Figure 7:
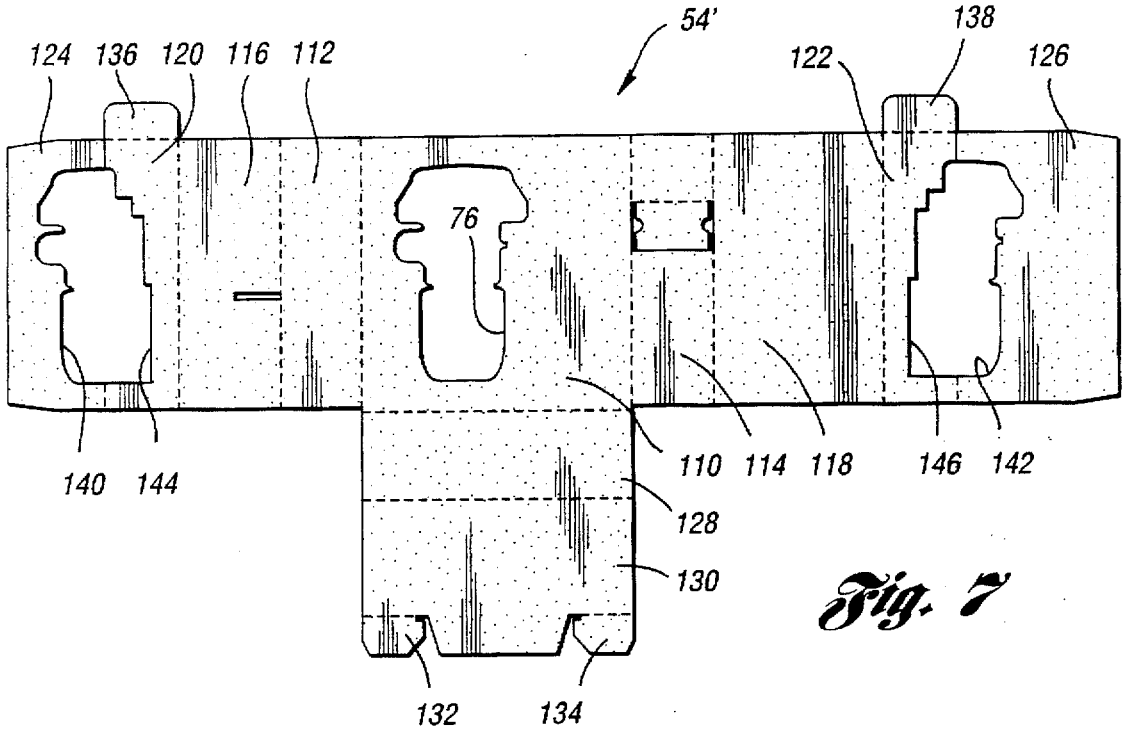
FIG. 7 is a plan view of the unfolded top insert.
Figure 8:
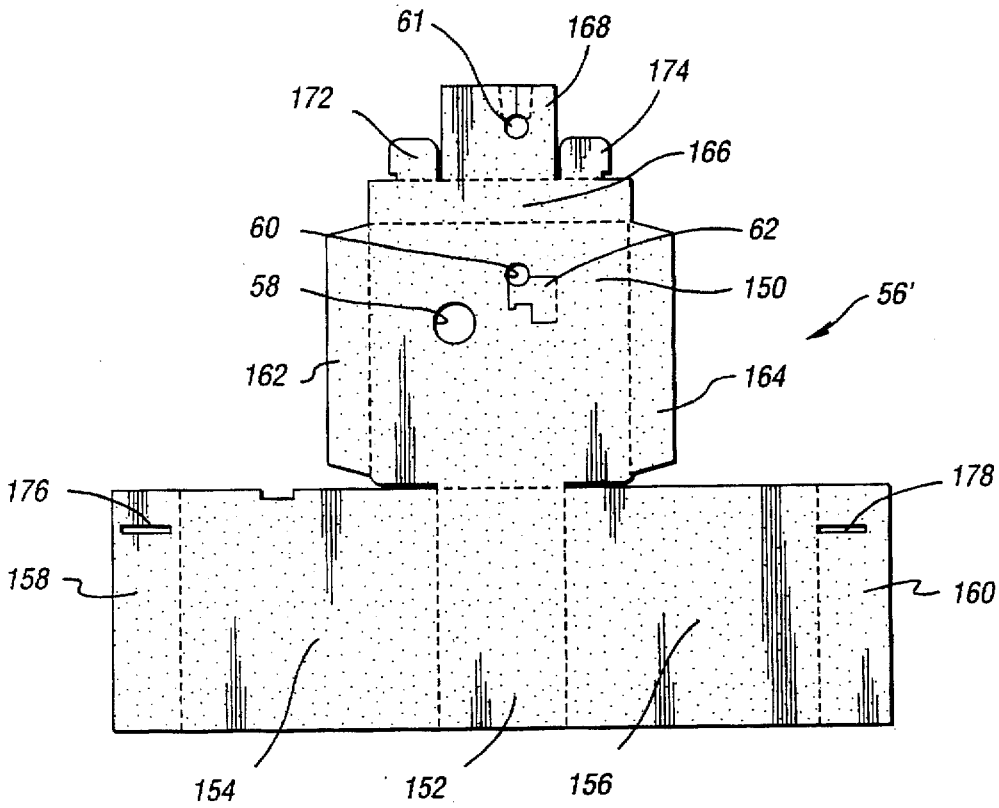
FIG. 8 is a plan view of the unfolded bottom insert.

FIG. 2 shows carton 22 without line trimmer 24 being mounted therein. Carton 22 comprises a main body 52, an upper insert 54 and a lower insert 56, which are shown partially assembled in FIG. 3. Upper and lower inserts 54 and 56 are retained within respective upper and lower portions of main body 52. FIG. 2 illustrates carton 22 with upper insert 54 and lower insert 56 retained within main body 52. Respective FIGS. 6, 7 and 8, illustrate main body 52, upper insert 54 and lower insert 56 prior to their being folded into individual interlocking configurations as shown in FIG. 3.

Figure 3:
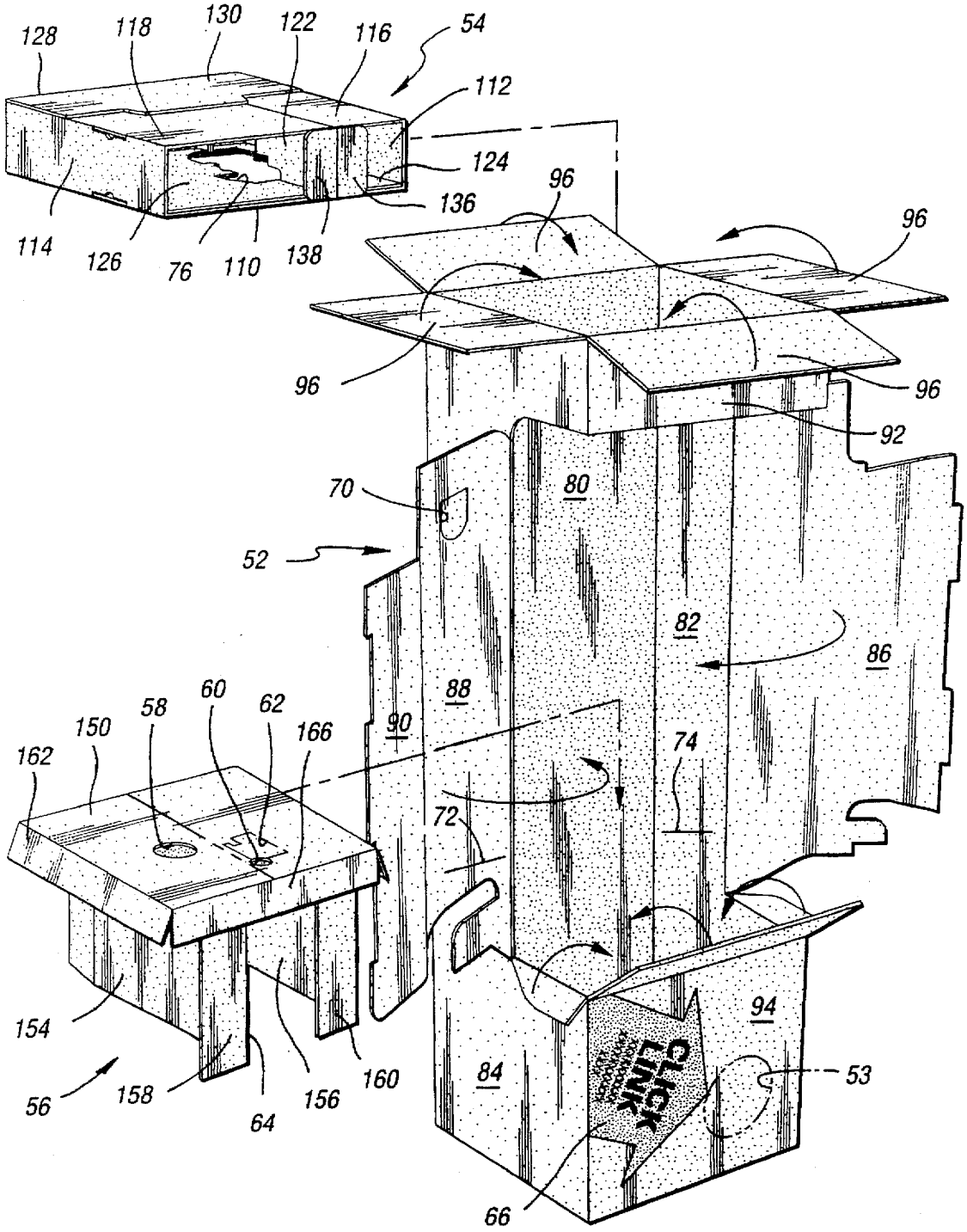
FIG. 3 is an exploded perspective view of a partially assembled display carton including an upper insert, a lower insert and a main body.
Figure 5:
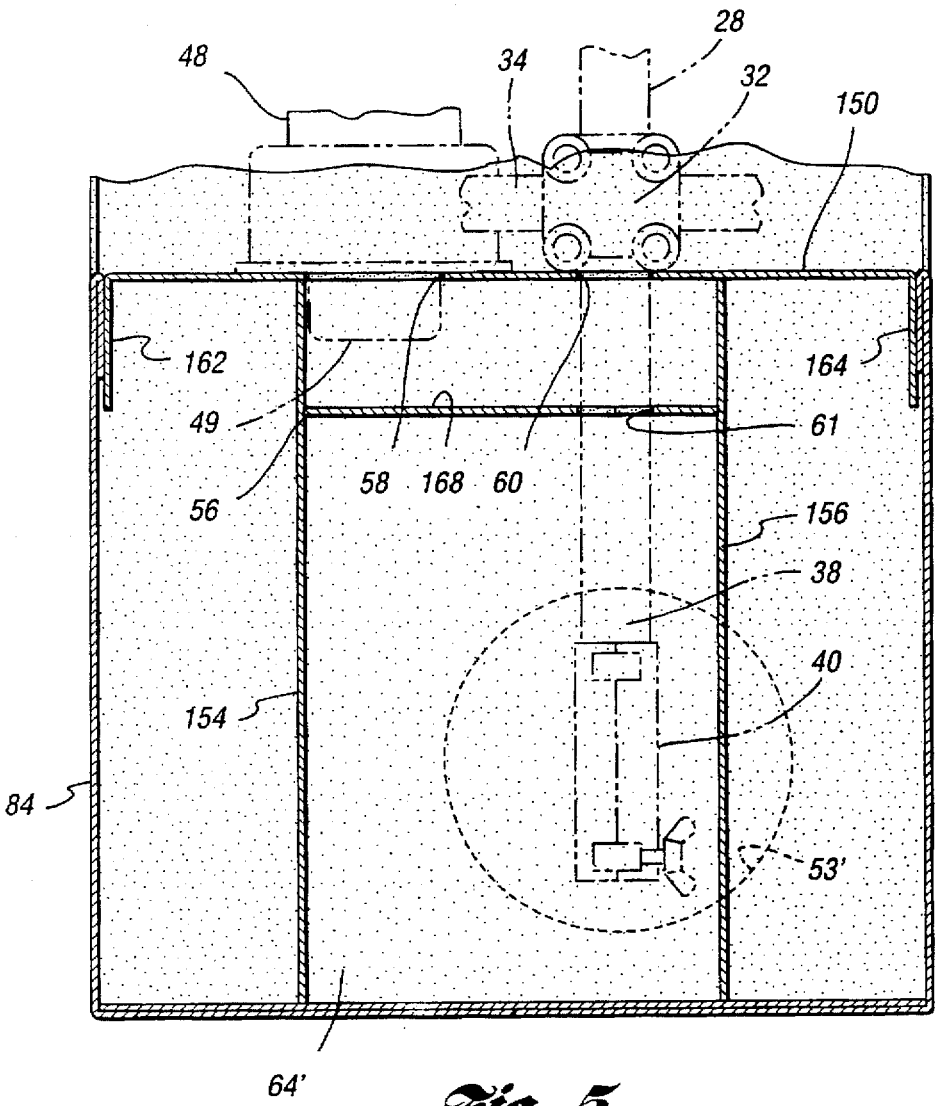
FIG. 5 is a fragmentary sectional view taken along line 5—5 of FIG. 2.

Referring to FIG. 3, lower insert 56 includes a large retaining aperture 58 and a smaller retaining aperture 60. Connected to smaller retaining aperture 60 is a flap 62 which is hingedly connected to the remainder of lower insert 56. Respective motorized and tool portions 25 and 26 are placed through the top of main body 52 with distal end 38 and connector 40 of motorized portion 25 and button 49 of line trimmer head 48 passing through respective retaining apertures 58 and 60. Flap 62 swings out of the way to allow connector 40 to pass through the top of lower insert 56. Distal end 36 of motorized portion 25 rests atop lower insert 56. FIG. 5 illustrates portions of first boom section 28 and button 49 of line trimmer head 48 being retained within retaining apertures 58 and 60. Lower insert 56 also has a second retaining aperture 61 spaced below and aligned with retaining aperture 60. Distal end 38 is also supported by retaining aperture 61.

At the lower front of carton 22 is a visual access opening 53. Similarly, lower insert 56 has a rectangular opening 64 defined therein. When lower insert 56 is properly positioned within carton 22, visual access opening 53 of main body 52 is aligned with rectangular opening 64 of lower insert 56. Accordingly, a purchaser can look through visual access opening 53 and aligned rectangular opening 64 and view connector 40. The dashed line 53' in FIG. 5 shows the alignment of visual access opening 53 relative to a rectangular space 64' defined by walls of lower insert 56. To encourage a purchaser to view a particular feature of interest observable through visual access opening 53, which in this exemplary embodiment is connector 40, indicia 66 is added to the lower portion of carton 22 to induce the purchaser to look through visual access opening 53.

Looking to FIG. 3, main body 52 includes a D-shaped retaining aperture 70 for holding distal end 44 of tool portion 26. Also formed in main body 52 are a pair of retaining slots 72 and 74 which cooperate to clamp about guard 50 of tool portion 26. After line advance button 49 is placed within retaining aperture 58, guard 50 is placed through retaining slots 72 and 74. Distal end 44 of tool portion 26 is then pressed through retaining aperture 70 thereby retaining tool portion 26 in carton 22.

Figure 4:
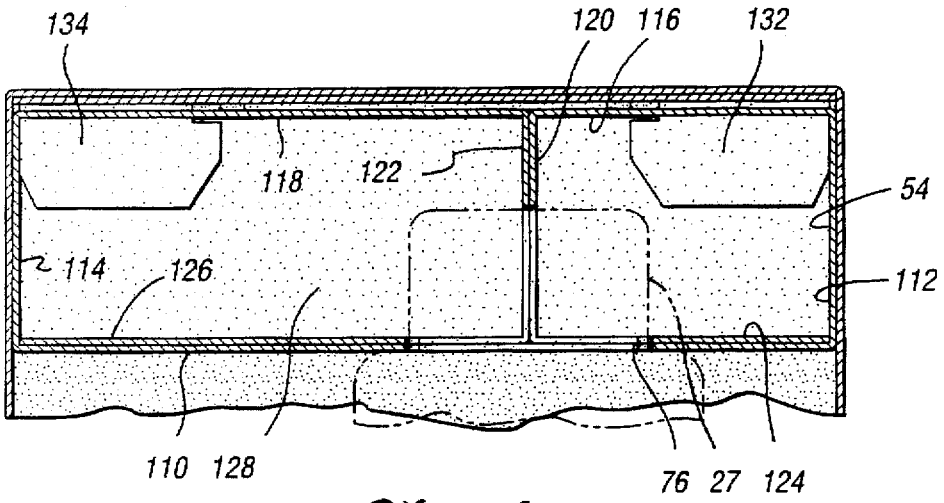
FIG. 4 is a fragmentary sectional view taken along line 4—4 of FIG. 2.

As best seen in FIG. 3, upper insert 54 has a motor retaining opening 76 which is configured to fit about the upper portion of motor 27. Motor 27 is shown in FIG. 4, in phantom, being retained within motor retaining opening 76 in upper insert 54. After tool portion 26 is secured within main body 52 and distal end 38 of motor portion 25 is retained within lower insert 56, top insert 54 is passed through a top opening in main body 52 with motor retaining opening 76 fitting over the top portion of motor 27. Top and bottom flaps on main body 52 are then stapled or otherwise secured together thus retaining line trimmer 24 in carton 22 and forming display arrangement 20.

Motorized and tool portions 25 and 26 are located adjacent one another and preferably are oriented in a generally upright position. Purchasers can readily see the majority of the intermediate portions of motorized and tool portions 25 and 26 for their appraisal in making a determination of whether or not to purchase the line trimmer 24 held within carton 22. This appraisal can take the form of not only a visual evaluation but also a tactile assessment of the majority of line trimmer 24 due to carton 22's open face construction. Further, the purchaser can view connector 40 through visual access opening 53 of main body 52 and rectangular opening 64 of lower insert 56. In conjunction with descriptive indicia 66, a purchaser can also readily appreciate that line trimmer 24 can be quickly assembled by simply inserting second boom section 42 into connector 40. Further, because line trimmer 24 is disassembled into two pieces, i.e., motorized and tool portions 25 and 26, the overall height of carton 22 is only slightly greater than the longer of the two motorized and tool portions 25 and 26, which this case is motorized portion 25. Consequently, arrangement 20 provides for a more compact packaging of line trimmer 24 than has been available in previous open face display carton and motorized implement arrangements. In the event that packaging engineers or marketing personnel believe that visual access to a particular feature, such as connector 40, is not necessary or appropriate, main body 52 can be made without a visual access opening and without any advertising or informational indicia such as indicia 66.

The particular die cut blanks forming main body 52, upper insert 54 and lower insert 56 will now be described in greater detail as will be their folded construction. Referring to FIG. 6, the die cut blank 52' used to construct main body 52 is shown. Major components of main body 52 include a rear panel 80, first and second outer panels 82 and 84, inner panels 86 and 88, back panel 90 and upper and lower front panels 92 and 94. A relatively narrow glue panel 95 is attached to outer panel 84.

Back panel 90 is physically separated from inner panel 86 as indicated by the solid cut line therebetween. Dashed lines in FIGS. 6–8 indicate fold lines. Outer panels 82 and 84 are generally C-shaped, and when main body 52 is fully constructed, extend forwardly from rear panel 80. Radiused contours 83 and 85 are formed on outer panels 82 and 84, located above the top inner panels 86 and 88. The presence of contours 83 and 85 significantly improve the strength and tear resistance of outer panels 82 and 84 relative to having corners which are right angles. Contours 83 and 85 each have approximately a one inch radius. Upper front panel 92 and lower front panel 94 will lie generally parallel to and spaced forwardly of rear panel 80. Inner panels 86 and 88 extend rearwardly from outer panel 82 and 84 toward rear panel 80 and interlock with one another. Back panel 90, connected to inner panel 88 will overlie rear panel 80. Upper flaps 96 and lower flaps 98 are also provided on main body 52 and cooperate to form respective top and bottom walls 100 and 102, as shown in FIG. 1. The portions of main body 52 above and below inner panels 86 and 88 can be considered to be upper and lower portions of main body 52. The remaining intermediate portion is a central portion of main body 52. Main body 52, when fully constructed, is generally C-shaped in side view, as suggested in FIG. 2.

Looking to FIG. 3, outer panel 82 is folded forwardly from rear panel 80. Upper and lower front panels 92 and 94 are then folded from right to the left as viewed in FIG. 3. Finally, outer panel 84 is folded rearwardly from upper front panel 92 and lower front panel 94. Although not shown, glue panel 95 is covered with glue and placed within and adjacent to rear panel 80 to hold main body 52 peripherally together in a rectangular configuration. Inner panel 86 is then folded rearwardly from outer panel 82 toward rear panel 80. Similarly, inner panel 88 is folded rearwardly from outer panel 82 with inner panels 86 and 88 interlocking with one another. As a result, back panel 90 lies adjacent and parallel to rear panel 80 extending from inner panel 88 toward outer panel 82. After upper insert 54 is inserted into the open top of main body 52, flaps 96 can be folded over one anther as indicated in FIG. 3 and glued or stapled together to produce top wall 100 of carton 22. Similarly, bottom panels 98 are folded over one another and fastened together to form bottom wall 102 allowing carton 22 to stand in an upright orientation.

Referring now to FIGS. 3, 4 and 7, top insert 54 is shown. The major panels of top insert 54 include a bottom panel 110, vertical side panels 112 and 114, top panels 116 and 118, vertical web panels 120 and 122 and overlying panels 124 and 126. Also included are a back panel 128 and an overlying top panel 130. Tabs 132, 134, 136 and 138 are attached to respective overlying top panels 130 and web panels 120 and 122 and help interlock top insert 54 together. When top insert 54 is fully assembled, overlying panels 124 and 126 overlie bottom panel 110. Contoured openings 140 and 142 in respective overlying panels 124 and 126 are aligned with opening 76 of bottom panel 110. Opening 76 is contoured to match the horizontal profile of motor 26. Similarly, web panels 136 and 138 have contours 144 and 146 which form a vertical contour which overlies the top profile of motor 27.

Finally, bottom insert 56 is shown in FIGS. 3, 5 and 8. Referring specifically to FIG. 8, bottom insert 56 includes a top panel 150, vertical rear panel 152, vertical side panels 154 and 156 and inboard extending front panels 158 and 160. Hingedly attached to top panel 150 are vertical side panels 162 and 164 and a vertical front panel 166. Retaining apertures 58 and 60 and flap 62 are formed in top panel 150. A horizontal panel 168 will extend parallel to top panel 150 with retaining aperture 61 being coaxially aligned with retaining aperture 60 in top panel 150. Flaps adjacent retaining aperture 61 accommodate connector 40 passing through retaining aperture 61. Tabs 172 and 174 are used to interlock with slots 176 and 178 to secure together bottom insert 56. Bottom insert 56 is shown in a folded configuration in FIGS. 3 and 5.

While in the foregoing specification this invention has been described in relation to a certain preferred embodiment thereof, and many details have been set forth for the purpose of illustration, it will be apparent to those skilled in the art that the invention is susceptible to alteration and that certain other details described herein can vary considerably without departing from the basic principles of the invention.

What is claimed is:

1. An open face carton and implement display arrangement comprising:

an operator carriable motorized implement including a motorized portion, a tool portion and a connector, the motorized portion having a motor and a first boom section extending from the motor and having a first end, the tool portion having a tool and a second boom section extending from the tool and having a second end, and the connector attached to one of the first and second ends for operatively connecting the first and second boom sections together; and a display carton having a main body and upper and lower inserts, the main body being generally C-shaped having a central portion and top and bottom portions which protrude forwardly from the central portion, the top and bottom portions retaining the upper and lower inserts therein, the main body having a rear panel, a pair of outer panels which extend forwardly from the rear panel and a pair of inner panels which extend from the outer panels toward the rear panel defining an open region between the inner panels;

the respective motorized and tool portions being retained in generally adjacent upright positions by the carton with at least a portion of each of the motorized and tool portions being tactiley accessible within the open region of the carton and the carton being slightly larger in height than the longer of motorized and tool portions and substantially less in height than the fully assembled motorized implement.

2. The arrangement of claim 1 wherein:

the connector is affixed at the first end of the first boom section and is retained within the lower insert.

3. The arrangement of claim 2 wherein:

the bottom portion of the main body has a bottom visual access opening therein which allows a point-of-sale purchaser to view the connector.

4. The arrangement of claim 3 wherein:

the lower insert has a lower visual access opening therein in alignment with the bottom visual access opening of the main body.

5. The arrangement of claim 1 wherein:

the second end of the tool portion is retained within a retaining aperture in one of the inner panels.

6. The arrangement of claim 1 wherein:

the lower insert has a pair of spaced apart retaining openings which respectively retain the tool and the connector.

7. The arrangement of claim 1 wherein:

the motor is at least partially retained within the upper insert.

8. The arrangement of claim 1 wherein:

one of the upper and lower portions of the main body has a visual access hole therein spaced from the open region and the connector is retained within one of the inserts and is visible through the visual access opening.

9. The arrangement of claim 1 wherein:

one of the lower and upper portions of the main body has a visual access opening therein for displaying one of the motor and the tool and the first and seconds ends of the motorized and tool portions.

10. An open face carton and implement display arrangement comprising:

an open face carton having a main body and upper and lower inserts, the main body having upper and lower portions and an intermediate central portion, the upper and lower portions respectively retaining the upper and lower inserts and at least one of the upper and lower portions has a visual access opening therein, and the main body having a rear panel, a pair of outer panels extending forwardly from the rear panel and a pair of inner panels extending rearwardly from the outer panels toward the rear panel, the inner panels defining an open region therebetween spaced from the visual access opening; and an operator carriable motorized implement having first and second ends with an intermediate boom extending therebetween, the motorized implement being retained by the upper and lower inserts; and at least a portion of the motorized implement being tactiley accessible within the open region of the main body and one of the retained ends of the motorized implement being visually accessible through the visual access opening in the one of the upper and lower portions of the main body.

11. The arrangement of claim 10 wherein:

the motorized implement is disassembled into a motorized portion including a motor and a tool portion including a tool whereby the overall height of the carton is substantially less than the height of the motorized implement when fully assembled.

* * * * *